US005722572A

United States Patent [19]

Pessina

[11] Patent Number: 5,722,572

[45] Date of Patent: Mar. 3, 1998

[54] MACHINE FOR IRONING CLOTH ARTICLES SUCH AS SHIRTS AND THE LIKE

[76] Inventor: Enzo Pessina, Via S. Maria, 17, 20047 - Brugherio (Milano), Italy

[21] Appl. No.: 425,978

[22] Filed: Apr. 20, 1995

[30] Foreign Application Priority Data

Apr. 29, 1994 [IT] Italy ..... MI9400311 U

[51] Int. Cl.[6] ..... A41H 5/00

[52] U.S. Cl. ..... 223/70; 223/52.1; 223/52; 223/57

[58] Field of Search ..... 223/70, 52.1, 68, 223/52, 57, 73, 76, 51

[56] References Cited

U.S. PATENT DOCUMENTS

| | | | |
|---|---|---|---|
| 2,041,581 | 5/1936 | Weisberg | 223/52.1 |
| 2,626,733 | 1/1953 | Maxwell et al. | 223/57 |
| 3,430,368 | 3/1969 | Wright | 223/70 |
| 3,603,490 | 9/1971 | Killey | 223/70 |
| 4,634,030 | 1/1987 | Uchikoshi | 223/70 |
| 4,875,301 | 10/1989 | Adams | 223/70 |
| 5,419,469 | 5/1995 | Urso | 223/70 |
| 5,474,216 | 12/1995 | Harrod et al. | 223/70 |

*Primary Examiner*—Bibhu Mohanty
*Attorney, Agent, or Firm*—Bucknam and Archer

[57] ABSTRACT

The present invention relates to an improved ironing machine, in particular for ironing cloth articles such as shirts and the like. The machine comprises a base structure which supports a first ironing station provided with a dummy for supporting from inside a cloth article to be ironed and with pressing elements which are turned to the outside of the dummy. The inside of the dummy is coupled to suction elements, and the pressing elements are provided with a device for delivering a hot fluid such as hot air or steam. The machine further comprises a second ironing station for ironing the neck and cuffs of the cloth article to be ironed. This second station comprises a bottom ironing panel for supporting thereon the cloth article to be ironed and a top ironing panel which can be driven toward the end away from the bottom ironing panel.

9 Claims, 9 Drawing Sheets

MACHINE FOR IRONING CLOTH ARTICLES SUCH AS SHIRTS AND THE LIKE

BACKGROUND OF THE INVENTION

The present invention relates to an improved ironing machine, which has been specifically designed for ironing cloth articles, such as shirts and the like.

Prior ironing machines for ironing cloth articles such as shirts and the like, conventionally comprise a dummy construction , which is used for ironing the body part of the shirt.

For ironing the neck and cuff portions of the shirts, on the other hand, there are used other types of ironing machines, thereby an operator must transfer the cloth article being ironed from one machine to the other in order to complete the ironing operation.

Accordingly, in order to iron cloth articles such as shirts and the like, there are conventionally necessary two different ironing machines.

This, as it should be apparent, in addition to the problem of making very difficult the ironing operation, for the operator, requires a large space in the ironing shop.

SUMMARY OF THE INVENTION

Accordingly, the aim of the present invention is to overcome the above mentioned drawbacks, by providing an improved ironing machine which can be used both for ironing the body part of cloth articles to be ironed, such as shirts and the like, and for ironing the neck and cuff parts of these articles.

Within the scope of the above mentioned aim, a main object of the present invention is to provide such an ironing machine which is suitable to perfectly iron cloth articles such as shirts and the like.

Another object of the present invention is to provide such an ironing machine which has a very reduced overall size much smaller than that of prior ironing machines.

Yet another object of the present invention is to provide such an ironing machine which is very reliable and safe in operation.

According to one aspect of the present invention, the above mentioned aim and objects, as well as yet other objects, which will become more apparent hereinafter, are achieved by an improved ironing machine, specifically designed for ironing cloth articles, such as shirts, characterized in that said ironing machine comprises a base structure, supporting a first ironing station, provided with a dummy for supporting the inside of a cloth article to be ironed and with pressing element facing an outside portion of said dummy, an inside portion of said dummy being coupled to suction means and said pressing elements including means for delivering a hot fluid, a second ironing station being moreover provided for ironing neck and cuff portions of said cloth article to be ironed, said second station including a bottom ironing panel for supporting thereon said cloth article to be ironed and a top ironing panel, which can be driven toward and away from said bottom ironing panel.

BRIEF DESCRIPTION OF THE DRAWINGS

Further characteristics and advantages of the improved ironing machine according to the present invention will become more apparent hereinafter from the following detailed disclosure of a preferred, though not exclusive, embodiment of said ironing machine, which is illustrated, by way of an indicative, but not limitative, example, in the figures of the accompanying drawings, where.

DESCRIPTION OF THE PREFERRED EMBODIMENTS

Figure 1:
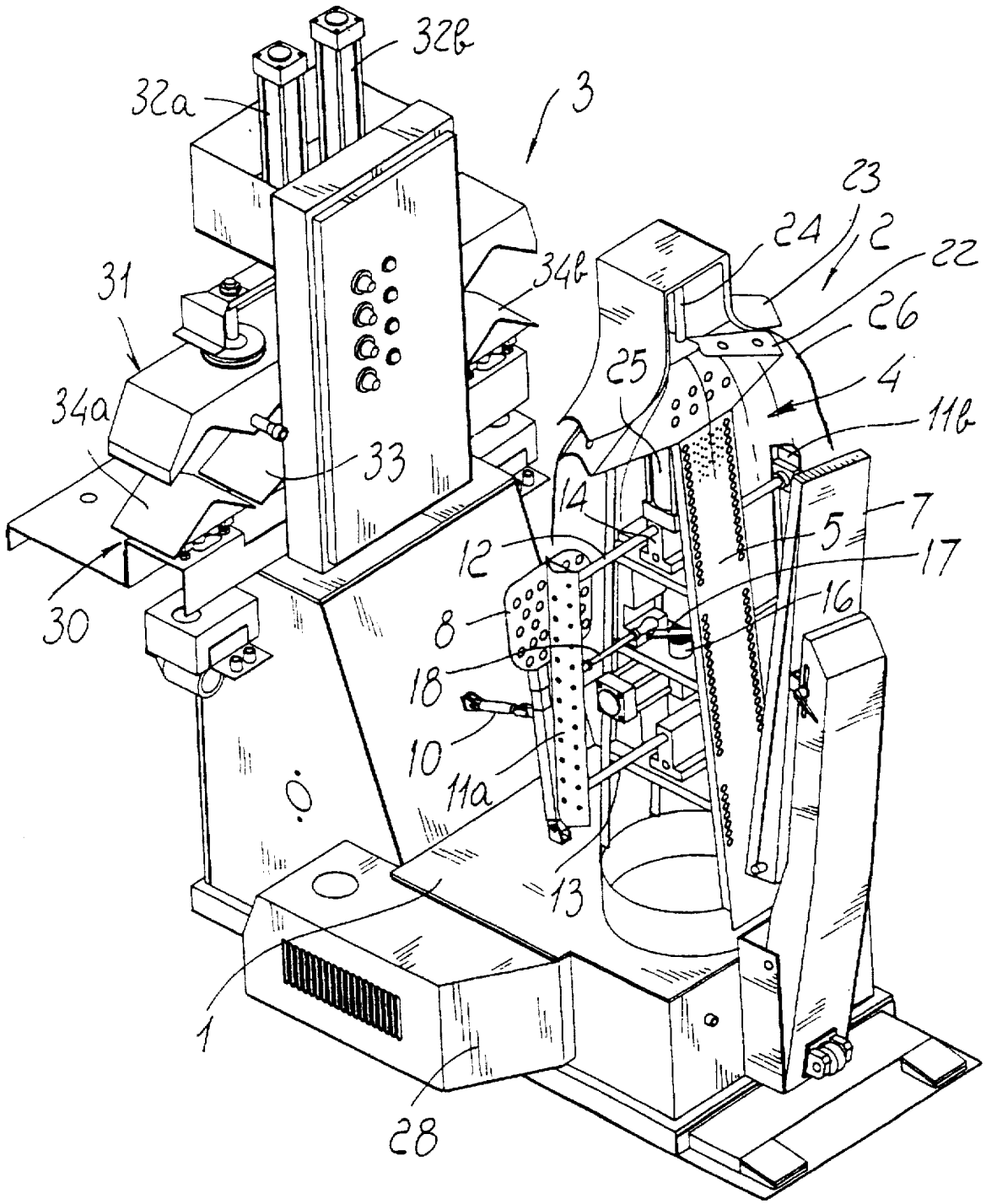
FIG. 1 is a schematic perspective view illustrating the improved ironing machine according to the present invention.
Figure 2:
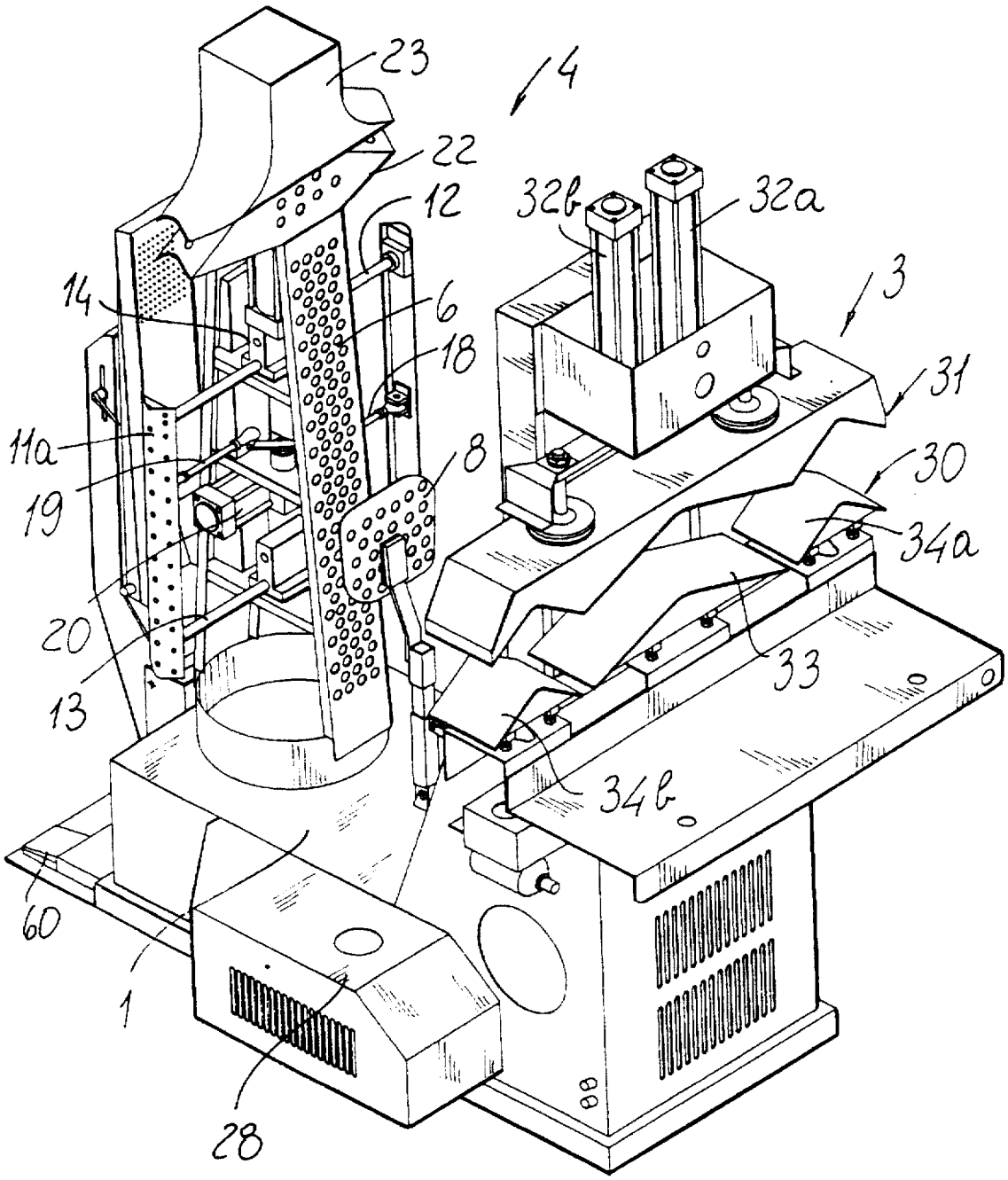
FIG. 2 is a further perspective view illustrating the ironing machine of the invention as seen from a direction different from that of FIG. 1.
Figure 3:
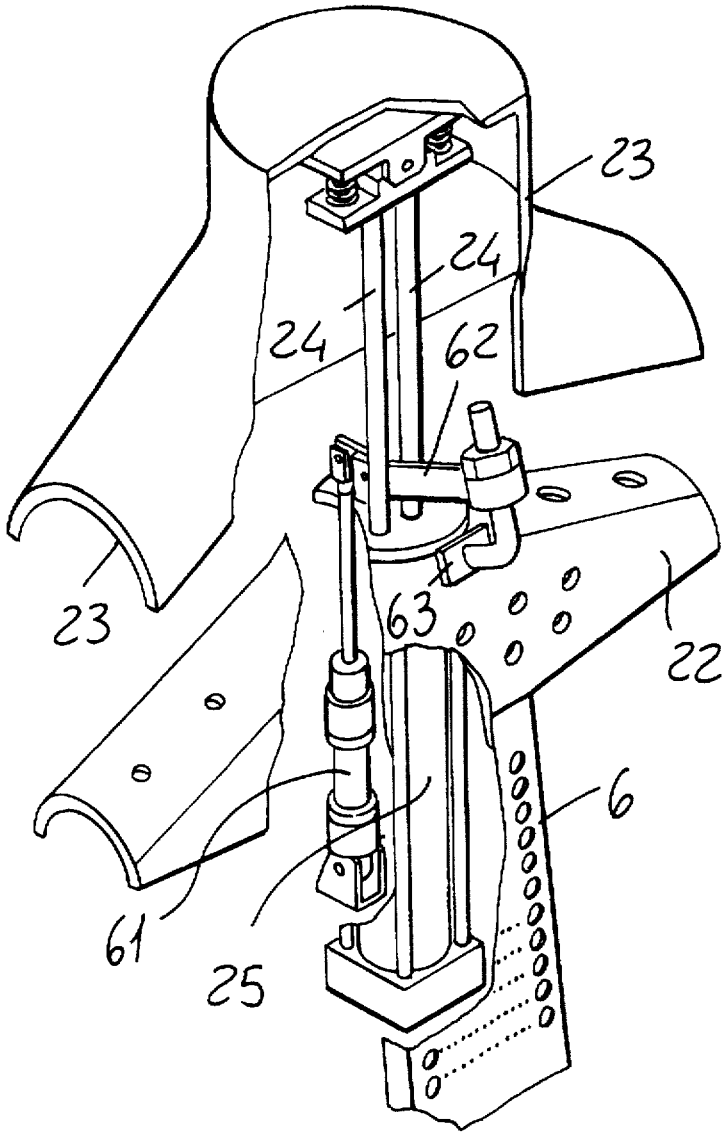
FIG. 3 is a further detailed perspective view of the top portion of the dummy included in the subject ironing machine, for ironing the shoulders of a shirt.
Figure 5:
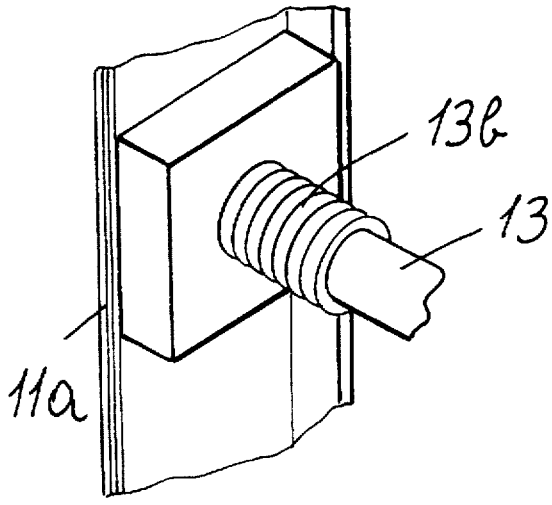
FIG. 5 is a detailed view of a horizontal shaft and of a support for supporting side pressing elements.
Figure 4:
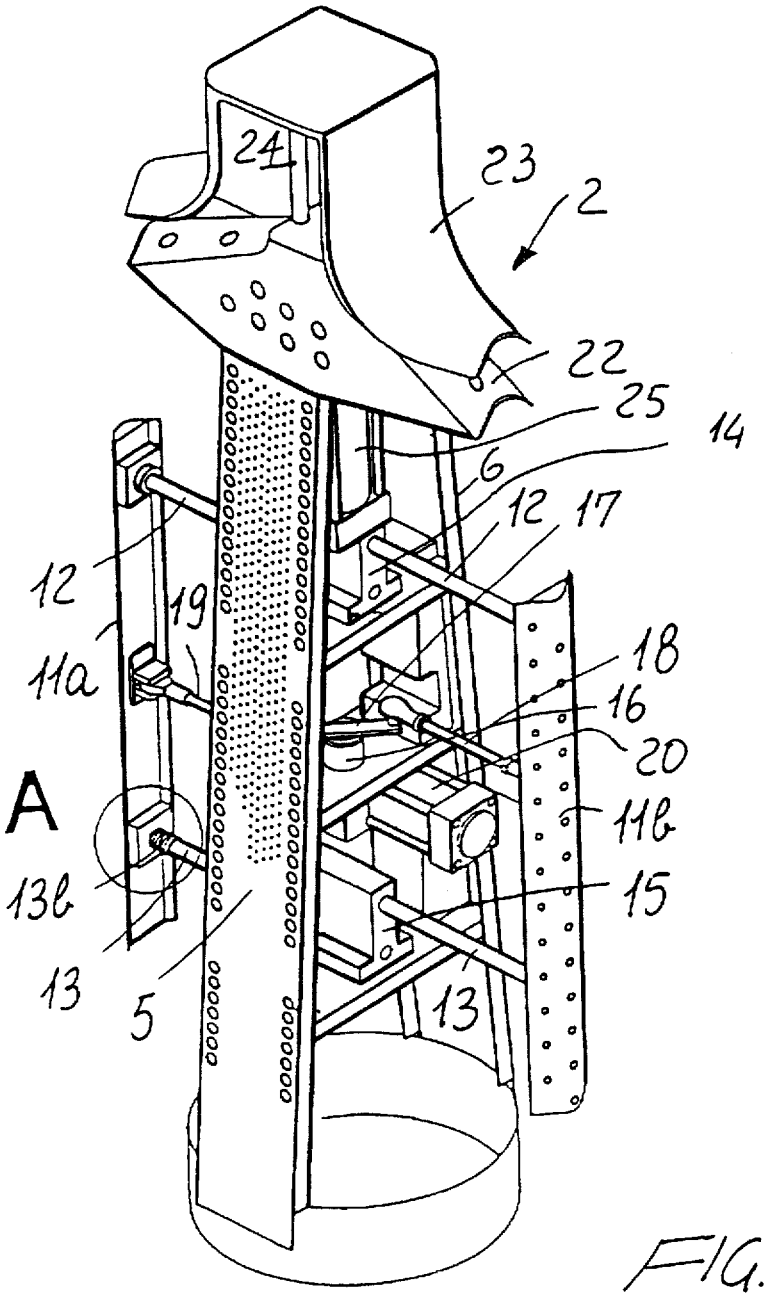
FIGS. 4 and 6 are two side perspective views of the dummy.
Figure 6:
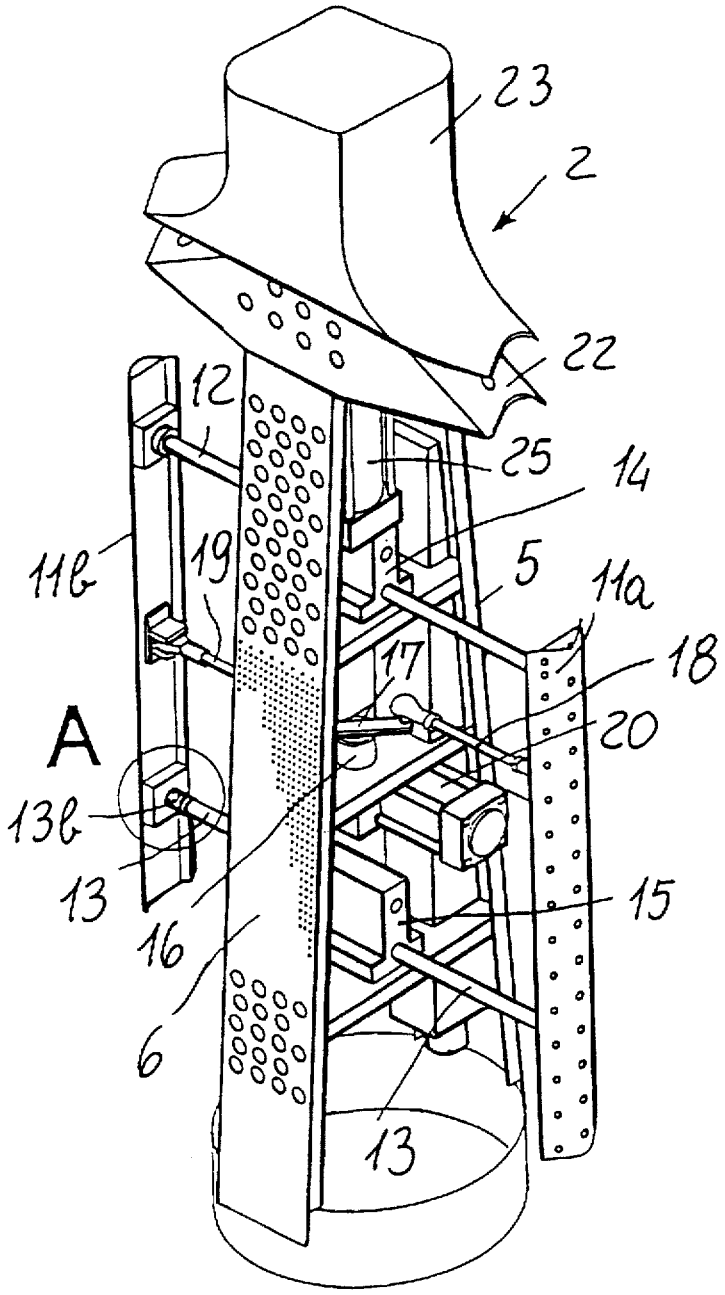

With reference to the number references of the above mentioned figures, the improved ironing machine according to the present invention comprises a supporting structure 1 which supports a first ironing station 2, in which there is performed the ironing of a cloth article body, such as, for example, the body of a shirt or the like, and a second ironing station 3, in which is ironed the neck and cuff portions of the cloth article.

More specifically, the first ironing station 2 comprises a dummy 4, which project from the supporting structure 1 and comprises a front perforated plate 5 and a rear perforated plate 6, said plates being coupled to a suction circuit of the machine and being outwardly directed, and respectively facing a front pressing element 7 and a rear pressing element 8, which pressing elements are also provided with perforations on the sides thereof facing the dummy 4.

In this connection, it should be pointed out that the front pressing element 7 and rear pressing element 8 are coupled to the delivery circuits of two turbosucking devices, for blowing air which, under the pressure effect, will reach a temperature of about 70° C.

As shown, the pressing elements 7 and 8 are supported, near the bottom end portion thereof, by the supporting structure 1, so as to swing about respective swinging axes and being adapted to be driven by fluodynamic actuators, of which there is shown only the pneumatic cylinder 10, driving the rear pressing element 8, so as to cause it to move toward or away from the dummy 4.

The dummy 4 further comprises side pressing elements 11*a* and 11*b* which are supported by the fixed framework 12 of the dummy 4, along horizontal sliding directions, so that they can be displaced from the inside of the dummy 4 toward the outside, in order to iron the cloth article at the side seam lines thereof.

More specifically, the side pressing elements 11*a* and 11*b* are also provided with a perforated plate, therethrough can be supplied or sucked a hot air or steam flow, in order to iron the side regions of the cloth article.

Each side pressing element 11*a* and 11*b* is mounted on horizontal shafts 12 and 13, which can slide inside guiding elements 14 and 15 affixed to the framework 1 of the dummy 4.

Moreover, this framework 1 further supports a shaft 16, having a vertical axis, which is provided with a crank 17 which is connected, by means of tie-rods 18 and 19, to the side pressing elements 11*a* and 11*b*.

The shaft 16 is rotatively driven, according to a set amplitude arch, by a pneumatic cylinder 20, fixed to the frame 1, so as to cause the side pressing elements 11*a* and 11*b* to be driven inwardly or outwardly of the dummy 4.

The tie-rods 18 and 19, which are associated with a spring 13*b*, will be suitable to compensate for the actions exerted by the side pressing elements 11*a* or 11*b* on the cloth article fabric.

The dummy 4, near the end top portion thereof, is provided with a shoulder ironing construction, which comprises a bottom ironing element 22, also provided with perforations for hot air or steam, and a top ironing element 23, which is heated by steam and which can be driven, with respect to the bottom ironing element 22, along a substantially vertical direction, in order to press on the cloth article to be ironed interposed with the shoulder region thereof, between the bottom ironing element 22 and the top ironing element 23.

In particular, the bottom ironing element 22 is connected to the frame 1 of the dummy 4, whereas the top ironing element is supported by a pair of vertical shafts or twin rods 24, which can slide inside the bottom ironing element 22.

On the top ironing element 23 operates a pneumatic cylinder 25, connected to the bottom ironing element 22, which cylinder will vertically drive the top ironing element 23 with respect to the bottom ironing element 22.

The dummy 4 further comprises an envelope 26, which encompasses the above mentioned structure, as well as the front plate 5 and rear plate 6, so as to enclose therein the side pressing elements 11*a* and 11*b*.

This envelope 26 is made of a fabric or other suitably porous material, so as to allow hot air or steam to pass therethrough.

The inside of the dummy 4 is coupled to the suction side of two turbosuckers, which are driven by universal commutator electric motors, which have a very reduced size and a very high performance.

In this connection it should be pointed out that the above mentioned turbosuckers will subject the air to such a pressure as to increase the air temperature to a value higher than 70° C.

The delivery side of these devices, which are housed in a suitable casing 28, is connected to the front pressing element 7 and the rear pressing element 8, so as to provide a closed loop.

The second ironing station 3 comprises a bottom ironing panel 30, which is connected to the supporting structure 1 of the machine, and a top ironing panel 31, which is movably supported by the supporting structure 1 so as to be driven along a vertical direction.

On the top ironing panel 31 operate two pneumatic cylinders 32*a* and 32*b*, which will cause the top ironing panel 31 to be raised or lowered with respect to the bottom ironing panel 30.

The bottom ironing panel 30 comprises a central region 33 for supporting the cloth article to be ironed, and two side regions 34*a* and 34*b* for bearing thereon the cuff portions of the cloth article to be ironed.

The top ironing panel 31 is so designed as to press the neck and cuff portions of the cloth article interposed between the bottom ironing panel 30 and the top ironing panel or element 31.

Both the bottom ironing panel 30 and the top ironing panel 31 can be provided with perforations for supplying and/or sucking hot air or steam.

The ironing machine according to the present invention operates as follows.

In order to iron a cloth article, the latter is at first arranged with its neck and cuff portions on the bottom ironing panel 30, and is ironed on these regions, by causing the top ironing panel 31 to be lowered, with an optional supplying of steam and air.

Then, the partially ironed cloth article is engaged on the dummy 4 so as to arrange the shoulder region thereof between the bottom ironing element 22 and the top ironing element 23.

During this step, by operating a foot pedal 60, is actuated the pneumatic cylinder 61 which will cause a movable rod 62 supporting a pressing element 63 to swing.

The pressing element 63 will hold perfectly located the shirt at the neck region thereof.

Then, the turbosucker 42 is operated, whereas the front pressing element 7 and rear pressing element 8 are caused to contact the cloth article engaged on the dummy.

Thus, the front and/or flaps of the shirt will be perfectly located.

Then, the top ironing element 23 is lowered on the bottom ironing element 22, whereas a fan, not shown, will provide a hot air flow through the cloth article being ironed and/or dried.

Moreover, is operated the pneumatic cylinder 20 to bring the side pressing elements 11*a* and 11*b* against the side seam regions of the cloth article.

Thus, the cloth article will be perfectly ironed in a very short time.

Figure 7:
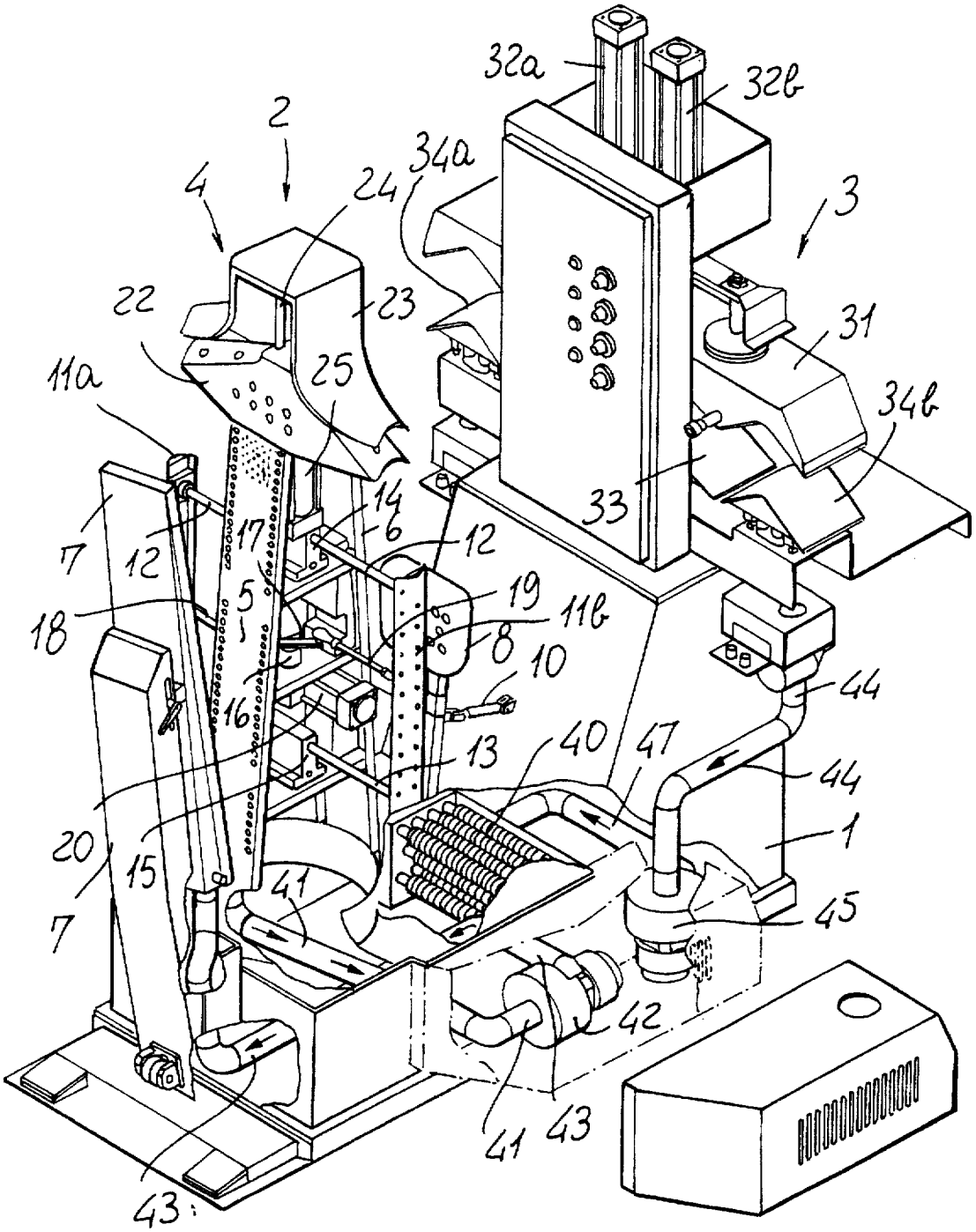
FIGS. 7 and 8 are two detailed perspective views of the ironing machine of the invention, in which there are clearly shown suction devices which are driven by universal commutator-electric motors, and which are provided for supplying air to several operating elements of the machine.
Figure 8:
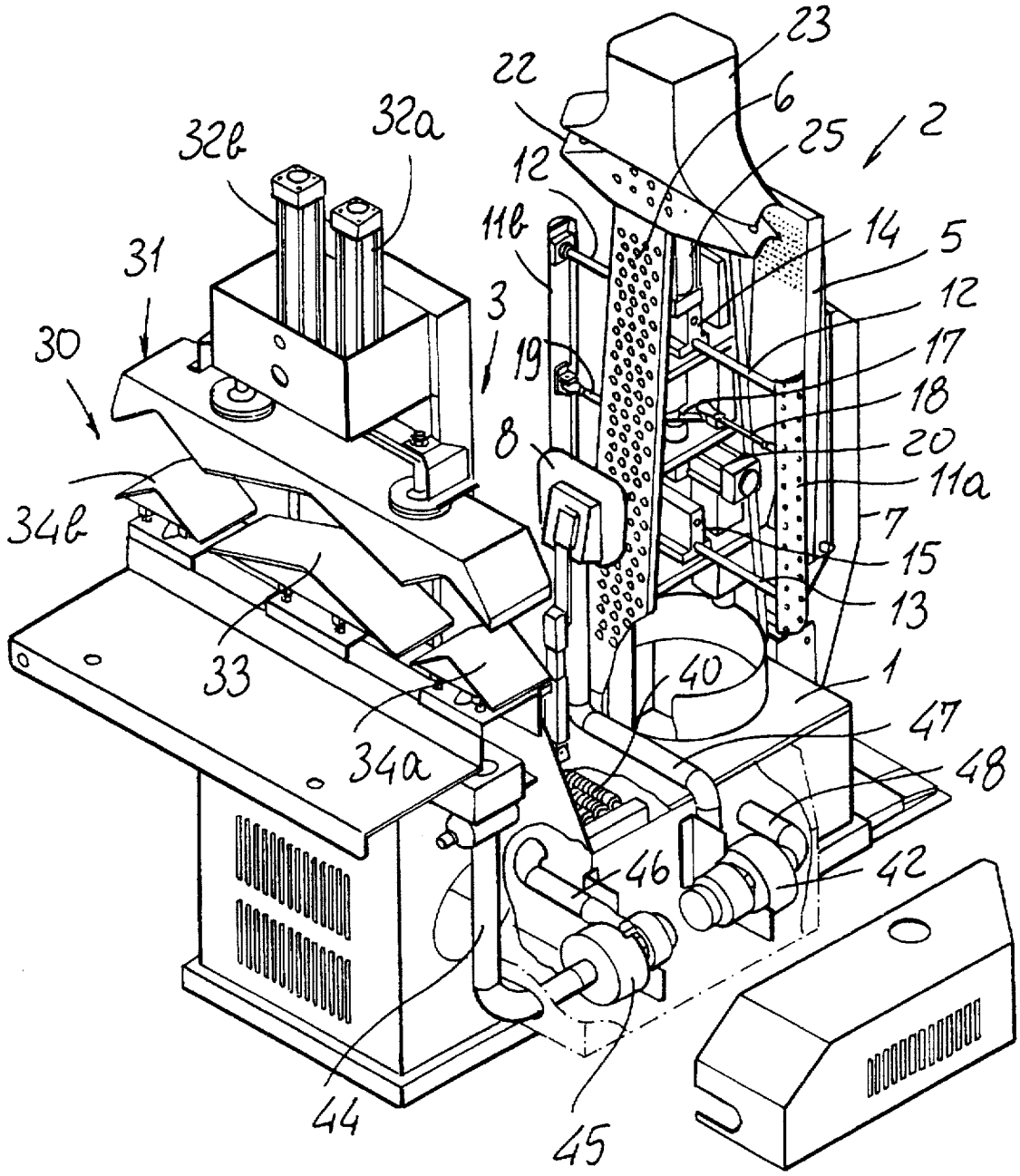

With reference to FIGS. 7 and 8, it should be apparent that the subject ironing machine comprises four turbosuckers 42 to 45, driven by universal commutator electric motors, which have a very reduced size and a very high performance.

In particular, two of the above mentioned turbosuckers are respectively coupled, under pressure, through the ducts 47 and 43, to the rear pressing element 8 and front pressing element 7 of the dummy.

The sucking and vacuum cycle is a closed loop cycle, in the specific case of the dummy.

FIGS. 7 and 8 further illustrate the two suckers 42, as well as the ducts 47, 48, 41 and 43, in which are clearly shown the air flows.

The moisture of the cloth article to be ironed is removed by sucking the wet air and conveying it on the radiating or coil element 40.

It should be moreover pointed out that the displacement of the neck and cuff region pressing panel is performed vertically and that the top portion of the dummy and, in particular, the movable top element 23, is supported by a pair of rods 24, preventing the top portion of the pressing element 23 from rotating with respect to the element 22.

Figure 9:
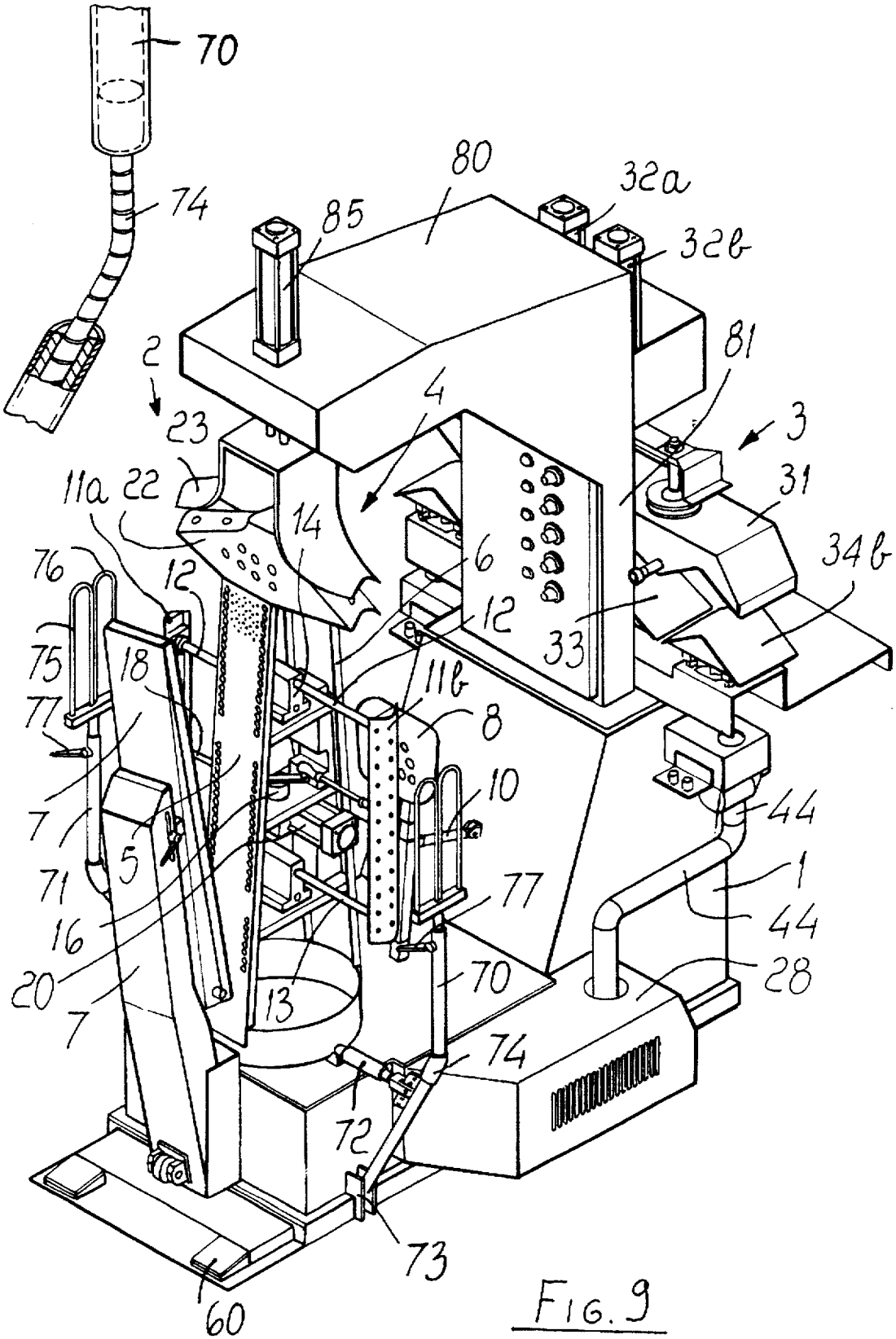
FIGS. 9 and 10 illustrate a further variation of the subject ironing machine, in which the ironing element 23 is supported on a cantilever supporting structure 80, bearing on the shoulder 81 of the ironing machine, and in which the bottom ironing element 22 is driven, with respect to the top ironing element, by a pneumatic cylinder 85, this modified embodiment allowing to perfectly iron cloth articles having a partially closed neck portion.
Figure 10:
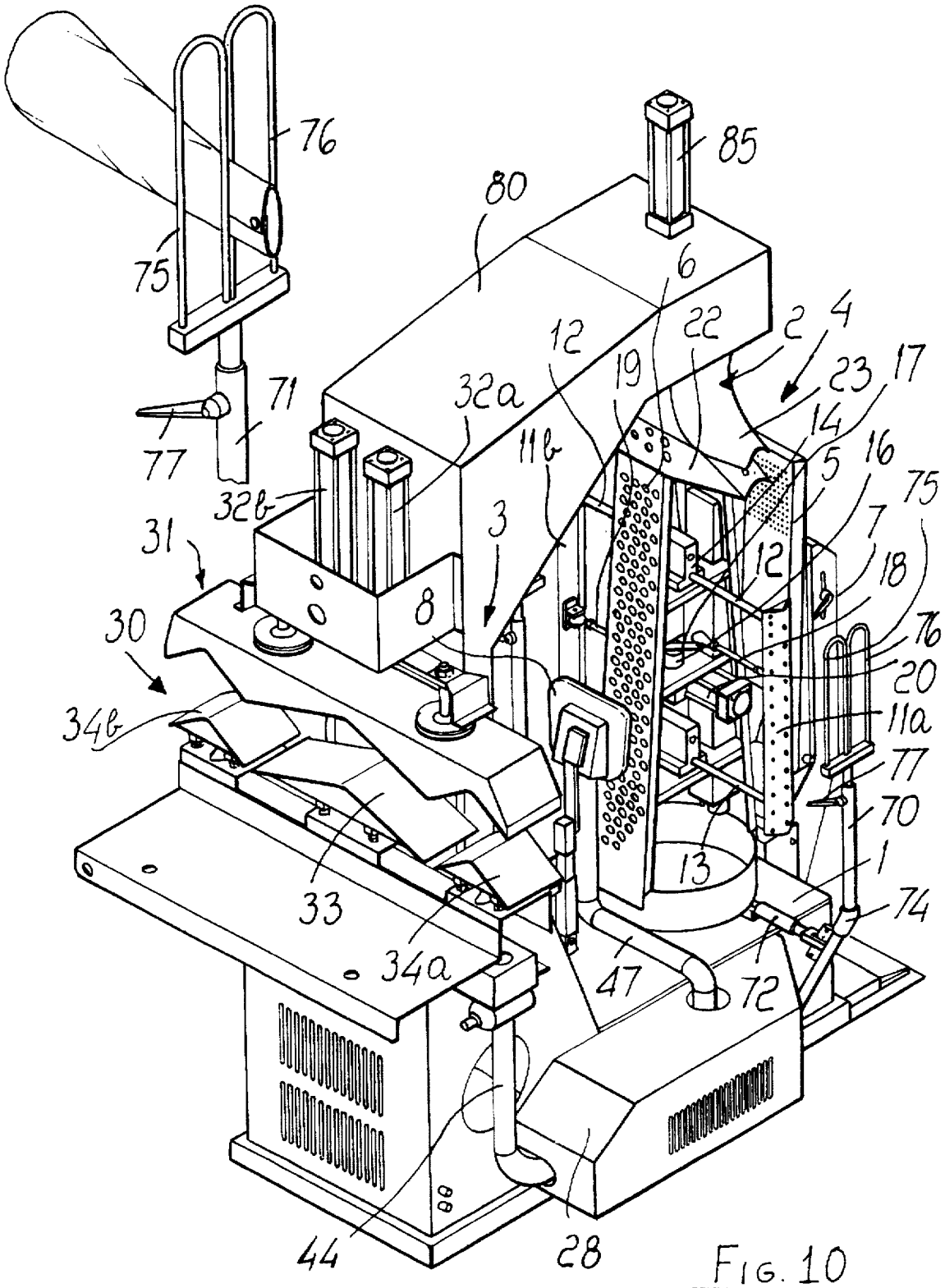

As shown in FIGS. 9 and 10, the ironing machine further comprises two articulated arms 70 and 71, driven by pneumatic cylinders 72, and connected to a bottom pivot pin 73 formed on the supporting structure of the machine.

The arms 70 and 71 are provided with flexible articulation portions 74 and support two curved elements 75 and 76 operating as grippers for holding the shirt cuff regions to be ironed.

These cuff regions can be introduced and removed in a very easy and quick manner.

In particular, the curved elements 75 and 76 are connected to the arms 70 and 71 by suitable clamping elements 77.

From the above disclosure and from the figures of the accompanying drawings it should be apparent that the invention fully achieves the intended aim and objects.

In particular, the fact is to be pointed out that an improved ironing machine has been provided, which allows to perfectly iron cloth articles such as shirts and the like, and which has a very reduced size; moreover, the operation thereof is very simple and quick.

A further advantage of the improved ironing machine according to the invention is that it provides a nearly full recirculation of the hot fluids such as, for example, hot air or steam, so as to provide very economic advantages since a very reduced power is required for operating the machine.

In practicing the invention, the used materials, as well as the contingent size and shapes can be any, according to requirements.

In this connection, it should be moreover pointed out that the subject machine can also be made in two discrete portions, comprising the several novel elements which have been disclosed and illustrated.

In other words, it is intended to separately claim the specific construction provided with a dummy for supporting the cloth article to be ironed and with elements facing the outside of the dummy, as well as the ironing station for ironing the neck and cuff portions of the cloth article to be ironed, said second station comprising a bottom ironing panel for supporting the cloth article to be ironed and a top ironing panel, which can be operatively driven toward or away from the bottom ironing panel.

I claim:

1. An ironing machine, specifically designed for ironing cloth articles, such as shirts, characterized in that said ironing machine comprises a supporting structure, supporting a first ironing station, provided with a dummy for supporting the inside of a cloth article to be ironed and with a pressing elements facing an outside portion of said dummy, an inside portion of said dummy being coupled to suction means and said pressing elements including means for delivering a hot fluid, a second ironing station being moreover provided for ironing neck and cuff portions of said cloth articles to be ironed, said second station including a bottom ironing panel for supporting thereon said cloth article to be ironed and a top ironing panel which can be driven toward and away from said bottom ironing panel to process said neck and cuff portions of said cloth article, said bottom ironing panel comprising a central region for supporting said cloth article to be ironed and two separate raised side regions for bearing thereon said cuff portions of said cloth article.

2. An ironing machine, according to claim 1, said dummy being arranged vertically and provided with a front perforated plate and a rear perforated plate, said pressing elements comprising a front pressing element facing said front perforated plate and a rear pressing element facing said rear perforated plate, said pressing elements being provided, on a side thereof facing said dummy, with perforations for supplying hot air and/or steam, said suction means comprising two turbosuckers having a delivery duct thereof coupled to said pressing elements and having a suction duct thereof coupled to the inside of said dummy, wherein said dummy comprises two movable side pressing elements which can be displaced from the inside of said dummy towards the outside thereof for ironing side seam portions of said cloth article.

3. An ironing machine, according to claim 2, wherein said side pressing elements are provided with perforations for hot air and/or steam.

4. An ironing machine, according to claim 1, wherein said bottom ironing panel is connected to said supporting structure, said top ironing panel being movable along a vertical direction with respect to said bottom ironing panel.

5. An ironing machine, according to claim 1, wherein on said bottom ironing panel and/or on said top ironing panel are provided perforations for supplying or sucking a hot fluid.

6. An ironing machine, according to claim 1, wherein said ironing machine further comprises turbosuckers operated by universal commutator electric motors.

7. An ironing machine, according to claim 6, wherein one of said turbosuckers is coupled, under pressure, through a duct, to one of said pressing elements and, under vacuum, to a fixed front frame of the dummy.

8. An ironing machine, according to claim 1, wherein said machine is further provided with a radiating element for heating air.

9. An ironing machine, according to claim 1, said machine further comprising two articulated arms driven by pneumatic cylinder means and connected to a bottom pin provided on said supporting structure of said machine, wherein said arms are provided with flexible articulated portions and support two curved elements operating as grippers for holding the cuff regions of the cloth article to be ironed, said curved elements being connected to said arms by clamping means.

* * * * *